United States Patent [19]

Davert et al.

[11] Patent Number: 4,879,875

[45] Date of Patent: Nov. 14, 1989

[54] FASTENER DRIVING TOOL

[75] Inventors: Edward J. Davert, Seattle; Peter D. McCowin, Enumclaw, both of Wash.

[73] Assignee: The Boeing Company, Seattle, Wash.

[21] Appl. No.: 171,752

[22] Filed: Mar. 22, 1988

[51] Int. Cl.[4] ..... F15B 7/08

[52] U.S. Cl. ..... 60/588; 60/592; 60/593; 173/116; 227/147

[58] Field of Search ..... 60/588, 592, 590, 593; 173/116, 119; 227/149, 130

[56] References Cited

U.S. PATENT DOCUMENTS

| | | | |
|---|---|---|---|
| 2,373,972 | 4/1945 | Moreno | 173/116 X |
| 2,845,197 | 7/1958 | Newstead | 218/47 |
| 3,199,415 | 8/1965 | Stanton et al. | 60/592 X |
| 3,396,572 | 8/1968 | Godsey | 72/452 |
| 3,475,945 | 11/1969 | Chirco | 72/391 |
| 4,050,285 | 9/1977 | Bosch et al. | 72/391 |
| 4,088,003 | 5/1978 | Schwab | 72/391 |
| 4,310,056 | 1/1982 | Olsson | 173/169 |
| 4,344,311 | 8/1982 | Inoue | 72/391 |
| 4,351,179 | 9/1982 | Feibiger | 72/391 |
| 4,484,443 | 11/1984 | Takigawa et al. | 60/593 X |
| 4,498,854 | 2/1985 | Ross | 91/463 X |
| 4,509,330 | 4/1985 | Zimber et al. | 60/593 X |
| 4,526,000 | 7/1985 | Saurwein | 60/593 X |
| 4,552,010 | 11/1985 | Hein | 72/391 |
| 4,615,206 | 10/1986 | Rosier | 72/391 |
| 4,688,468 | 8/1987 | Axinti et al. | 173/119 X |
| 4,690,225 | 9/1987 | Tupitsyn et al. | 60/593 X |

FOREIGN PATENT DOCUMENTS

| | | | |
|---|---|---|---|
| 2450560 | 5/1976 | Fed. Rep. of Germany | 173/116 |
| 800427 | 3/1956 | United Kingdom | 83/4 |
| 2179703 | 3/1987 | United Kingdom | 173/116 |

*Primary Examiner*—Edward K. Look

*Attorney, Agent, or Firm*—Christensen, O'Connor, Johnson & Kindness

[57] ABSTRACT

A fastener driving tool for driving remotely located fasteners through preformed openings in a structure. The tool (10) comprises a housing (12) having a pneumatic-hydraulic intensifier (14) mounted thereon and a remotely located second hydraulic cylinder assembly (20) attached to the housing (12) by means of an extension tube (110). Pressurized air is provided to the tool (10) through a cartridge regulator (36) that is controlled by a trigger assembly (41). A pneumatic piston (72), connected to a first hydraulic piston (76) by a piston rod (80), moves from a first position located away from a nose portion (66) to a second position located toward a nose portion (66). The pressurizing valve (56) admits air to the pneumatic piston (72) to cause the first hydraulic piston (76) to move to the second position, thereby pressurizing hydraulic fluid (92) and causing the second hydraulic piston (102) to extend from the second cylinder housing (104). A rotating union (22) connects the extension tube (110) to the housing (12) and permits rotation of the second hydraulic cylinder assembly (20) about the longitudinal axis of the pneumatic-hydraulic intensifier (14). A fluid reservoir (68) supplies fluid to the first hydraulic cylinder assembly (18) and captures entrapped air bubbles within the fluid (92).

11 Claims, 4 Drawing Sheets

FASTENER DRIVING TOOL

TECHNICAL FIELD

The present invention relates to fastener installation tools, and, more particularly, to a fastener driving tool for inserting remotely located fasteners into preformed openings in a structure.

BACKGROUND OF THE INVENTION

Assembly of aircraft wing leading edge structures requires mechanical fastening of ribs to outer skin structure. Typically, interference press fit fasteners are first inserted through preformed openings in the ribs and then a retainer is placed on the fastener to secure the assembly. In many transport-size aircraft wings, the ribs inside the wing leading edge are spaced as close as several inches apart, thus limiting access to the area in which the fasteners are to be installed.

Previously, insertion of fasteners was accomplished by hand because of the limited working space. However, insertion of the first two or three fasteners through the rib structure was found to be difficult because of initial misalignment of the openings. As a result, a lever bar and wedge were used to force each fastener into position. This method proved unsuitable because damage frequently occurred to the structure and repair became necessary.

One attempt to overcome this difficulty involved the use of a hand-pumped hydraulic cylinder that was reworked to fit into the confined space between the ribs. As the cylinder is pumped, the piston extends therefrom and pushes the fastener through the opening. This method has the disadvantage of being awkward because it requires the use of both hands to hold and operate the pump within the confined pace. In addition, this method is slow because several strokes of the pump lever are required to activate the hydraulic cylinder. Hence, there is a need for a tool that can be easily placed in the confined space between the ribs and quickly operated to drive the fasteners through the openings.

SUMMARY OF THE INVENTION

In accordance with this invention, a fastener driving tool for inserting remotely located fasteners into preformed openings in a structure is provided. The fastener driving tool formed in accordance with this invention comprises a housing; a hydraulic pressure means, preferably in the form of a pneumatic-hydraulic intensifier, for generating hydraulic pressure; activation means, preferably in the form of a trigger and cartridge valve assembly, for activating the pneumatic-hydraulic intensifier; and, a hydraulic cylinder remotely located from the housing having a hydraulic piston in fluid communication with the pneumatic-hydraulic intensifier. The hydraulic piston is mounted within the hydraulic cylinder for movement between a retracted position and an extended position such that upon activation of the pneumatic-hydraulic intensifier the hydraulic piston is extended to urge at least one fastener through the preformed opening, and, when the pneumatic-hydraulic intensifier is deactivated, the hydraulic piston retracts.

In accordance with another aspect of the present invention, the hydraulic cylinder is attached to the housing by a rotating union that permits the hydraulic cylinder to rotate about a longitudinal axis. Preferably the longitudinal axis passes horizontally through the pneumatic-hydraulic intensifier.

In accordance with yet another aspect of the present invention, the tool further includes a hydraulic fluid reservoir located within the housing and in fluid communication with the hydraulic cylinder so that when the pneumatic-hydraulic intensifier is deactivated, lost fluid is replenished and entrapped air bubbles are captured within the reservoir.

In accordance with yet a further aspect of the present invention, the tool further includes anticavitation means to prevent fluid cavitation when the pneumatic-hydraulic intensifier is deactivated. Ideally, the anticavitation means includes a spring mounted within the hydraulic cylinder to urge the hydraulic piston to move to the retracted position when the pneumatic-hydraulic intensifier is deactivated. Additionally, an exhaust air fixed orifice restriction is used to limit pneumatic-hydraulic intensifier operating speed.

In accordance with yet another aspect of the present invention, the tool includes a flow restrictor orifice to regulate the operating speed of the pneumatic-hydraulic intensifier.

As will be readily appreciated from the foregoing description, the present invention provides a fastener driving tool having a remotely located hydraulic cylinder for driving remotely located fasteners through preformed openings in a structure. The tool is lightweight and includes a hand grip with a trigger mechanism that facilitates one-handed operation of the tool. The rotating union allows the remotely located hydraulic cylinder to be quickly positioned within hard-to-reach working areas. Furthermore, the pneumatic-hydraulic intensifier unit permits operation of the tool with standard pneumatic pressure sources while at the same time developing hydraulic pressure sufficient to drive fasteners through the openings in a structure.

BRIEF DESCRIPTION OF THE DRAWINGS

The foregoing and other advantages and features of the present invention will be better understood from the following description of the preferred embodiment of the invention when taken in conjunction with the following drawings, wherein.

DETAILED DESCRIPTION OF THE PREFERRED EMBODIMENT

Figure 1:
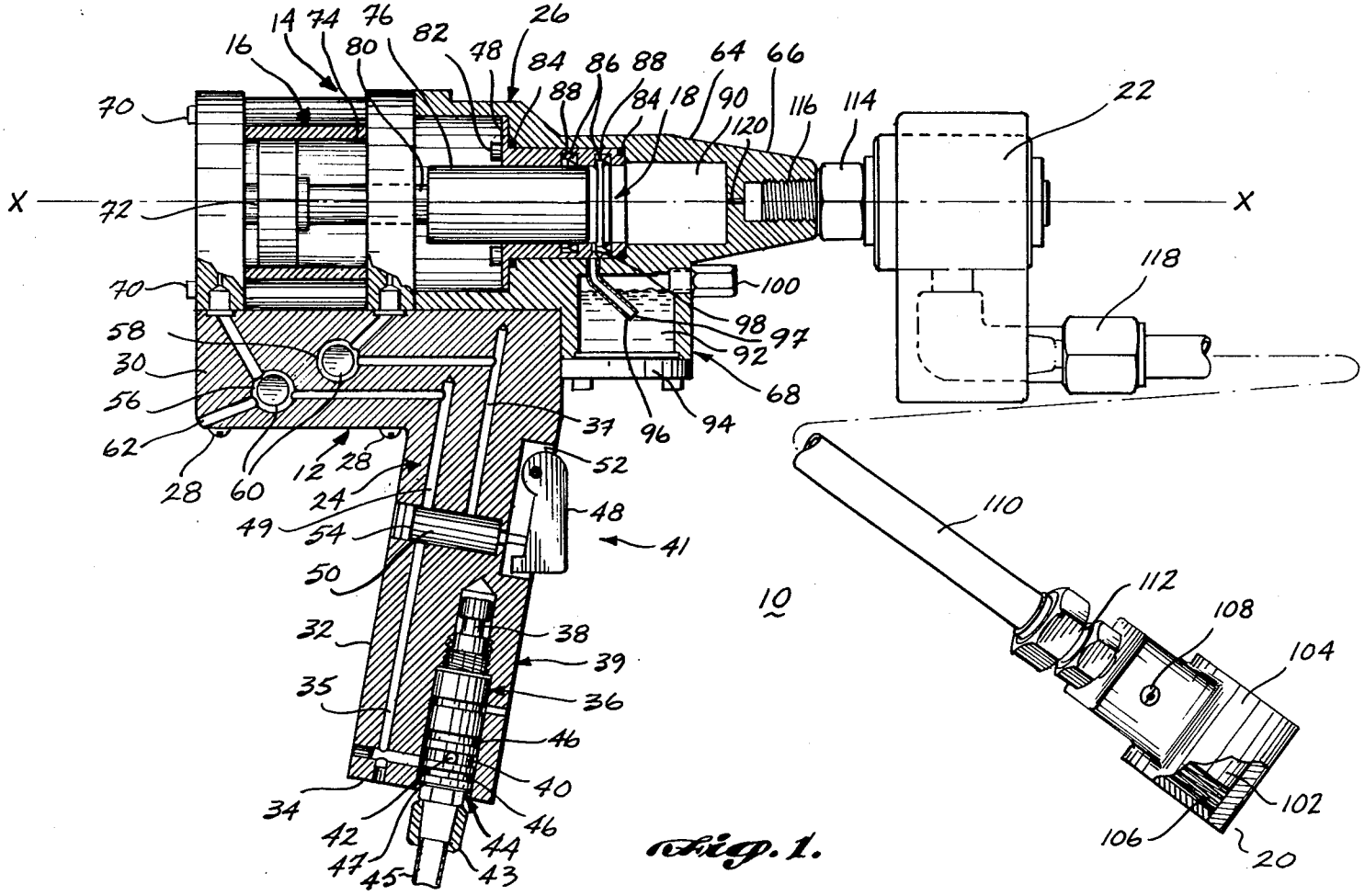
FIG. 1 is a side partial cross-sectional view of a fastener driving tool formed in accordance with the present invention.

FIG. 1 shows the construction and assembly of a fastener driving tool 10 formed in accordance with the present invention. The tool 18 includes a housing 12, a pneumatic-hydraulic intensifier 14 comprised of a pneumatic cylinder member 16 and a first hydraulic cylinder member 18 mounted within the housing 12, a remotely located second hydraulic cylinder member 20, and a rotating union 22 connecting the second hydraulic cylinder member 20 to the housing 12.

The housing 12 is formed of two sections, a handle section 24 and an intensifier section 26, that are held together by four fasteners 28. The handle section 24 includes a platform portion 30, to which the intensifier section 14 is fastened, and a grip portion 32 that is sized and shaped to facilitate gripping by an operator's hand. The grip portion 32 has a front surface 39, in which a trigger assembly 41 is mounted, and a bottom surface 34, into which a cartridge regulator 36 is inserted. Air passages 35, 37, and 49 are formed within the grip portion 32 that pneumatically connect the trigger assembly 41 and the cartridge regulator 36 to the intensifier section 14.

The cartridge regulator 36 includes a flow adjusting valve 38 having a machined groove 40 with a port 42 formed therein, a quick disconnect fitting 44, and O-ring seals 46. By inserting the adjusting valve 58 in the grip portion 32, the pressure adjustment becomes tamperproof. While the particular cartridge regulator 36 illustrated in FIG. 1 is designed to be mounted to a panel, it has been modified for the present invention with the machined groove 40 and the port 42 to permit air to flow from the port 42 to the air passage 35. The quick disconnect fitting 44 connects a source of pressurized air (not shown) to the tool 10. Since pneumatic quick disconnect fittings are well known and commercially available, the construction of the quick disconnect fitting 44 will not be described in detail. In general, such fittings comprise a male component 43, typically attached to a hose 45, and a female component 47, typically attached to the tool 10, that can be rapidly connected and disconnected.

The trigger assembly 41 comprises a trigger 48 and a trigger valve 50. The trigger 48 is pivotally mounted within a recess 52 formed in the front surface 39 of the grip portion 32. The trigger valve 50 is preferably a two-way cartridge valve that is positioned inside a chamber 54 formed in the grip portion 32 adjacent to the trigger recess 52. Because such cartridge valves are also well known and commercially available, the construction of the trigger valve 50 is not described in detail here. Briefly, the valve 50 is moved by the trigger 48 between a first position and a second position to direct the flow of pressurized air to either of the air passages 37 and 49. The trigger 48 is positioned so that an operator holding the grip portion 32 with one hand can squeeze the trigger 48 with one or more fingers of the same hand.

Located within the platform portion 30 of the handle section 24 are two additional three-way cartridge valves, a pressurizing valve 56 and a return valve 58. Both valves are of the cartridge type described above and have multiple airways to direct air flow through multiple air passages. They are positioned within chambers 60 that are in communication with the trigger valve 50 via the air passages 37 and 49. In addition, the chambers 60 are in communication with the pneumatic cylinder member 16. Briefly, the trigger valve air cartridge 50 is used to turn on or off the cartridge air valves 56 and 58. When the return valve 58 shuts to the off position, the pressurizing valve 56 shuttles to the on position, and vice versa. Hence, the two valves 56 and 58 flip-flop on and off when an air signal is sent from the trigger valve 50. The air exhaust of valve 56 is throttled by a flow restrictor orifice 62 positioned on the platform portion 30 to control the return speed of the pneumatic piston to thereby reduce the possibility of fluid cavitation. The size of the orifice 62 is set at fabrication to permit the one-way flow of air out of the pneumatic cylinder member 16 at a predetermined rate selected by the application requirement. In the preferred embodiment, the orifice has a diameter of 0.19 inches. Because rapid movement of the first hydraulic piston 76 as it returns to the first position can cause cavitation of the hydraulic fluid, the flow restrictor orifice 62 is used as an anticavitation device by slowing the rate of return of the hydraulic piston 72. Squeezing of the trigger 48 by the operator's hand pivots the trigger 48 into contact with the trigger valve 50, urging the trigger valve 50 to move to the first position thereby directing pressurized air through the air passage 39 and to the pressurizing valve 56. Releasing the trigger 48 causes the trigger valve 50 to move to the second position, thereby directing the pressurized air through the air passages 37 to the return valve 58.

The intensifier section 26 comprises the pneumatic-hydraulic intensifier 14, a first hydraulic cylinder housing 64, a nose portion 66, and a fluid reservoir 68. The pneumatic cylinder assembly 16 is attached to the first hydraulic cylinder housing 64 by a plurality of fasteners 70. The pneumatic cylinder assembly 16 includes a pneumatic piston 72 slidably mounted within a pneumatic cylinder 74. The first hydraulic cylinder assembly 18 includes a first hydraulic piston 76 slidably mounted within a cylinder sleeve 78 that is attached to the interior of the first hydraulic cylinder housing 64. The pneumatic piston 72 and the first hydraulic piston 76 are mounted on opposite ends of a piston rod 80. In this configuration the two piston reciprocate in tandem along a common longitudinal axis X between a first position wherein the pistons are distal from the nose portion 66, as shown in FIG. 1, and a second position wherein the pistons are proximal to the nose portion 66.

Figure 4A:
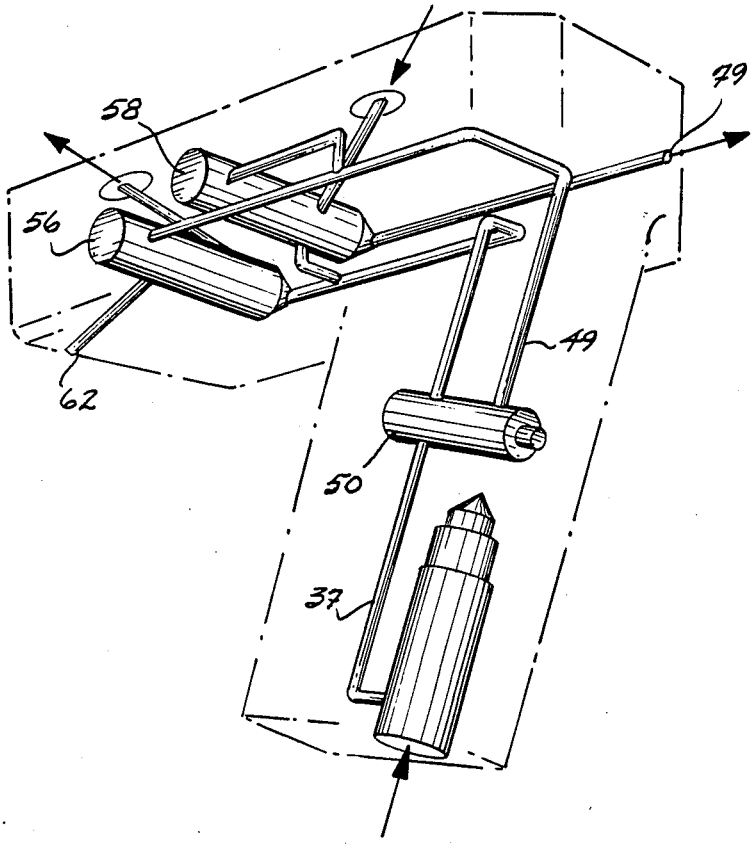
FIGS. 4A–B are pictorial illustrations showing the airflow paths through the pneumatic control system.

Referring now to FIG. 4A in conjunction with FIG. 1, when the trigger assembly 41 is activated, pressurized air is admitted by trigger valve 50 through air passages 49 to the valve 56, pressurizing the pneumatic cylinder 74. The pressurizing valve 56 is moved by the force of the pressurized air to a first position to direct the pressurized air to the pneumatic cylinder assembly 16, forcing the pneumatic piston 72 to slide from the first position to the second position. As the pneumatic piston 72 slides to the second position, the return valve 58 slides to the first position and permits air trapped between the pneumatic piston 72 and the first hydraulic cylinder assembly 18 to escape through an exhaust port 79. Movement of the pneumatic piston 72 to the second position causes the interconnected first hydraulic piston 76 to move to the second position in the cylinder sleeve 78.

Figure 4B:
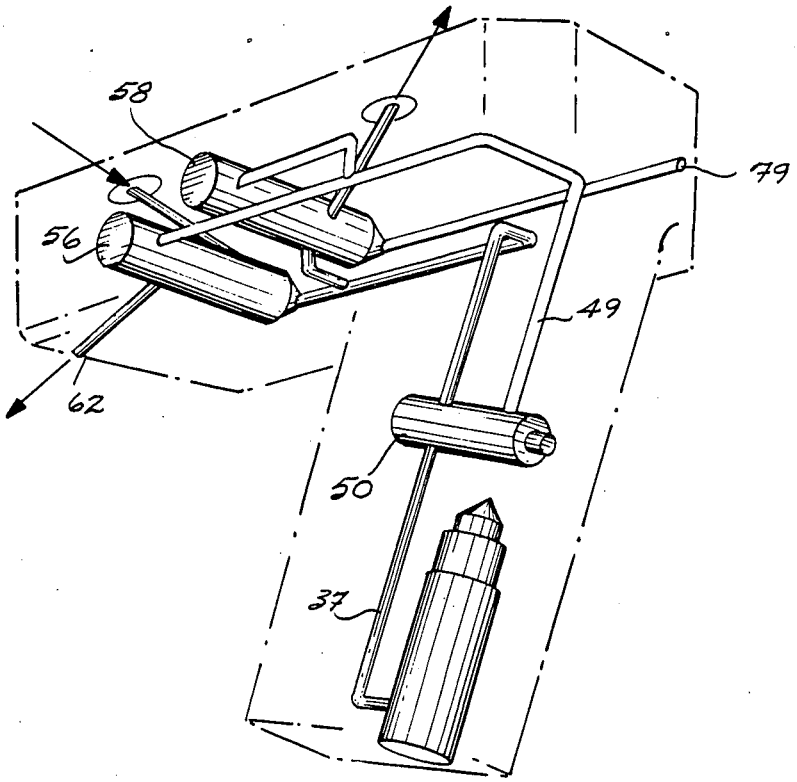

Referring now to FIG. 4B, when the trigger valve assembly 41 is deactivated, pressurized air is directed through the air passages 37 to the return valve 58. At this point, the return valve 58 is repositioned by the pressurized air signal. The return valve 58 directs the pressurized air to the pneumatic cylinder assembly 16 to force the pneumatic piston 72 to move from the second position back to the first position. As the pneumatic piston 72 slides to the first position, air trapped within the pneumaic cylinder 74 is allowed to escape through the flow restrictor orifice 62 via the pressurizing valve 56 to control retraction speed, thereby reducing the possibility of cavitation. Movement of the pneumatic piston 72 to the first position causes the interconnected first hydraulic piston 76 to also move to the first position within the cylinder sleeve 78.

The cylinder sleeve 78 is fastened to the first hydraulic cylinder housing 64 by four cap screws 82. Two O-ring seals 84 are positioned between the first hydraulic cylinder housing 64 and the cylinder sleeve 78 to seal the assembly and prevent hydraulic fluid leaks. In addition, two ring seals 86 having a Y-shaped cross section are mounted in grooves 88 formed in the cylinder sleeve 78 and extend to the piston to prevent leakage between the piston and the cylinder sleeve as the piston slides through the cylinder sleeve 78.

With the first hydraulic piston 76 in the first position, a cavity 90 is created in the first hydraulic cylinder housing 64 that is filled with hydraulic fluid 92 from the fluid reservoir 68. The reservoir 68 is integrally formed with the first hydraulic cylinder housing 64. A tube 96 provides a fluid path from the reservoir 68 through the housing 64 to the cylinder sleeve 78. A cap 94 covers the reservoir 68 and is removable to permit refilling of the reservoir. Preferably, the cap 94 is constructed of transparent material to allow visual checking of the fluid level in the reservoir 68.

An opening 98 is formed in the sleeve 78 between the two Y-shaped seals 86 to allow fluid to move into the sleeve and then into the cavity 90 when the first hydraulic piston 76 is fully in the first position. As the first hydraulic piston 76 moves to the second position, as described above, it covers the opening 98 and slides past the seals 86. With the opening 98 thus sealed off, fluid pressurized by the first hydraulic piston 76 in cavity 90 cannot escape into the reservoir. Preferably, the tube 96 is positioned in the reservoir 68 so that no matter what the orientation of the tool 10, the open end 97 of the tube 96 will remain in the fluid, thus preventing air from being drawn into the cavity area 90. Finally, a check valve 100 is mounted to extend through the housing 64 and is in pneumatic communication with the reservoir 68 to provide one-way air flow into the fluid reservoir 68. This maintains the reservoir 68 at ambient air pressure and prevents build-up of negative pressure due to transfer of fluid out of the reservoir 68.

As is also shown in FIG. 1 the remotely located second hydraulic cylinder assembly 20 comprises a second hydraulic piston 102 slidably mounted within a second cylinder housing 104. The piston 102 slides between a first position, wherein the piston 102 is retracted within the housing 104, and a second position, wherein the piston 102 is partially extended from the housing 104. A return spring 106 is attached to the housing 104 and the piston 102 to urge the piston 102 to return from the second position to the first position. The return spring 106 acts as an anticavitation device that insures the hydraulic fluid remains under positive pressure. A bleed screw 108 is threadably engaged in the second cylinder housing 104 and is used to bleed air from the hydraulic fluid 92 as will be described more fully hereinafter.

The second cylinder housing 104 is attached to an extension tube 110 that carries the hydraulic fluid from the cavity 90 in the housing 64 to the second hydraulic cylinder assembly 20. A threaded male fitting 112 is mounted on the extension tube 110 and threadably engages the cylinder housing 104. In one embodiment, the extension tube 110 is bent along its length at an angle to the X-axis to facilitate positioning of the tool 10. Preferably, the extension tube 110 is bent at an angle of 30° from the X-axis, although it will be clear that other angles or orientations may also be used depending on the job to be performed.

The extension tube 110 is connected to the nose portion 66 of the tool 10 by the rotating union 22. Because the rotating union 22 is well known and commercially available, it will not be described in detail. The particular union illustrated in FIG. 1 is a low-speed air-hydraulic rotating union manufactured by the Deublin Company located in Northbrook, Ill. This union was selected because of its high strength and ability to bear the cantilever loads exerted by the bent extension tube 110 without leaking. The union 22 includes a male fitting 114 that engages a threaded opening 116 in the nose portion 66 and an elbow fitting 118 that connects to the extension tube 110. The union 22 rotates the extension tube 110 and the second hydraulic cylinder 20 about the X-axis.

A small passageway 120 in the nose portion 66 allows fluid 92 to flow from the cavity 90 through the union 22 and into the extension tube 110. The passageway 120 is sized as determined by the application requirements to control the operational extension speed of the hydraulic piston 102. Thus, as the first hydraulic piston 76 moves from the first position to the second position, the hydraulic fluid 90 flows through the passageway 120 and the extension tube 110 to the second hydraulic cylinder assembly 20 to thereby extend the second hydraulic piston 102 out of the second cylinder housing 104. The size difference between the pneumatic piston 72 and the first hydraulic piston 76 are such that the relatively small pneumatic pressures are intensified to higher hydraulic pressures. While most construction and repair facilities utilize pressurized air at approximately 100 pounds per square inch, the losses will drop this pressure to approximately 85 pounds per square inch at the pressurizing valve 56. Preferably, the ratio of sizes the pneumatic piston and the first hydraulic cylinder are such that a pressure amplification of 5.2 to 1.0 results. For example, 85 pounds per square inch of air pressure at the pneumatic cylinder produces 444.38 pounds per square inch of hydraulic pressure, which result in a piston force of approximately 348.8 pounds.

To reduce surface wear during fastener insertion, the second cylinder housing 104 is preferably constructed of tool steel hardened to Rc 58. The housing 64 and the handle section 24 may be machined from aluminum or constructed of other lightweight metal or composite material.

OPERATION

The operation of the fastener driving tool 10 will now be described in conjunction with FIGS. 1, 2, 3A and 3B. After the fastener driving tool 10 is assembled, the hydraulic cylinders must be primed prior to operation. This is accomplished by first orienting the tool 10 so that the cap 94 over the reservoir 68 is facing upward. The bleed screw 108 is removed from the second cylinder housing 104. The cap 94 is removed and the reservoir 68 is filled with suitable hydraulic fluid. The cap 94 is then positioned over the reservoir 68 and held in place. The tool 10 is connected to an air supply, and a rag is placed over the opening for the bleed screw 108. The trigger assembly 41 is then activated to cause the first hydraulic cylinder assembly 18 to pump the hydraulic fluid into the extension tube 110 and into the second hydraulic cylinder assembly 20. As hydraulic fluid 92 is drained out of the reservoir, the cap 94 is removed and hydraulic fluid is added. As the hydraulic fluid 92 begins to bleed out of the opening to the bleed screw 108, the bleed screw 108 is partially threaded into the opening to allow continued bleeding of the tool 10. The trigger assembly 41 is activated until a steady flow of hydraulic fluid 92 flows from the bleed screw 108. At this point, the trigger is released, the bleed screw 108 is tightened and the reservoir 68 is filled. The tool 10 is then positioned with the second hydraulic cylinder member 20 vertically lower than the first hydraulic cylinder member 18 and the trigger assembly 42 is operated to allow air remaining in the fluid system to rise through the tube 96 into the reservoir. Finally, the reservoir 68 is again filled and the cap 94 is secured to the reservoir 68.

Figure 2:
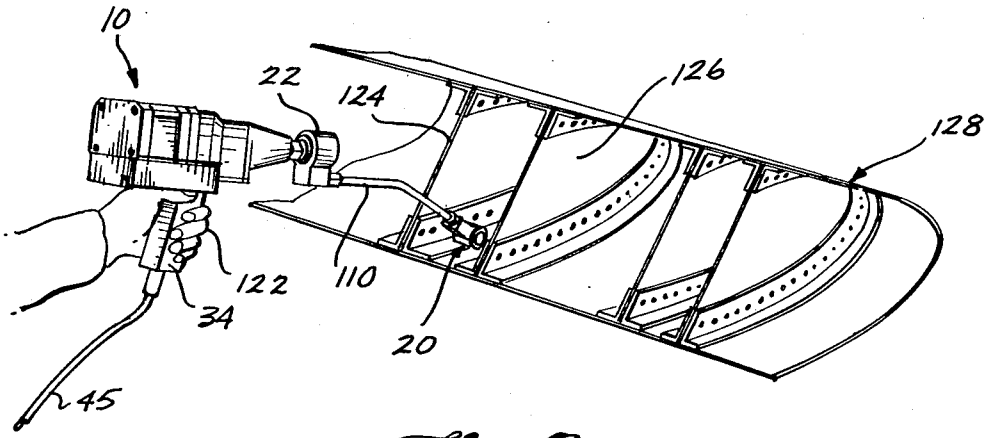
FIG. 2 is an isometric view of the operation of the fastener driving tool of FIG. 1.
Figure 3B:
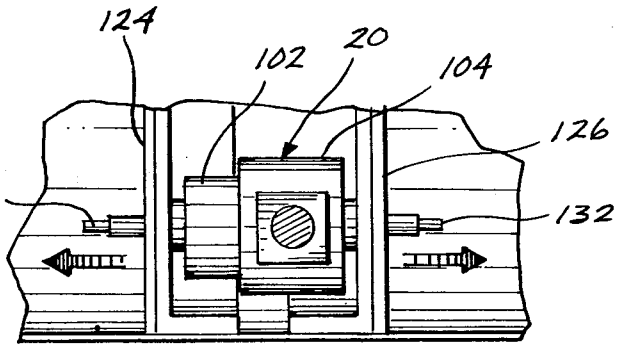
FIGS. 3A–B are enlarged pictorial diagrams showing the placement and operation of the remote cylinder illustrated in FIG. 2.
Figure 3A:
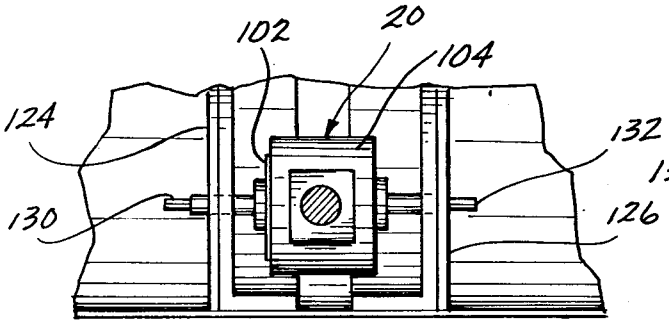

FIG. 2 shows the tool 10 being gripped by an operator's hand 122 in the normal operating position. Here the second hydraulic cylinder assembly 20 is shown placed between a first rib assembly 124 and a second rib assembly 126 inside a leading edge assembly 128 of a typical aircraft wing. As is more clearly shown in FIG. 3A, the second hydraulic cylinder assembly 20 is positioned between a first fastener 130 partially inserted through the first rib assembly 124 and a second fastener 132 that is partially inserted through the second rib assembly 126. With the tool 10 so positioned, the operator squeezes the trigger 48 to activate the pneumatic-hydraulic intensifier 14. This causes pressurization of the second hydraulic cylinder assembly 20, which forces the second hydraulic piston 102 to extend from the second cylinder housing 104. The extension of the second hydraulic piston 102 to the left as shown in FIG. 3A forces the first fastener 130 through the first rib assembly 124. At the same time the reaction force exerted to the right by the extension of the second hydraulic piston 102 causes the second hydraulic housing 104 to force the second fastener 132 through the second rib assembly 126, as is shown in FIG. 3B.

Once the fasteners are driven through the rib assemblies, the trigger 48 is released, allowing the second hydraulic piston 102 to retract within the second cylinder housing 104. The tool 10 may then be repositioned between another set of fasteners. A single fastener may be driven in the manner described above by placing the second hydraulic assembly 20 between the fastener and a fixed structure, such as a rib, to thereby brace the second hydraulic housing as the piston is extended.

It is to be understood that while the preferred embodiment has been described in the context of aircraft wing assemblies, the present invention has application outside of the aircraft art. In addition, while a preferred embodiment of the invention has been illustrated and described, it will be appreciated that various changes can be made therein without departing from the spirit and scope of the invention. For instance, the second hydraulic cylinder assembly may be constructed to have two opposed pistons within the cylinder housing, each piston extending in opposite directions along a common longitudinal axis. Consequently, the invention can be practiced otherwise than as specifically described herein.

The embodiments of the invention in which an exclusive property or privilege is claimed are defined as follows:

1. A fastener driving tool for inserting remotely located fasteners into a preformed opening in a structure, comprising:

a housing;

a hydraulic pressure generating means located within said housing for generating hydraulic pressure;

a hydraulic cylinder means remotely located from said housing and having a hydraulic piston in fluid communication with said hydraulic pressure generating means, said hydraulic piston being mounted within said hydraulic cylinder means for movement between a retracted position and an extended position, such that upon activation of said hydraulic pressure generation means said hydraulic piston is extended to thereby insert at least one fastener through the preformed opening; and a hydraulic fluid reservoir located within said housing, said hydraulic fluid reservoir being in fluid communication with said hydraulic cylinder means only when said hydraulic pressure generating means is not generating pressure, such that fluid is directed from said reservoir to said hydraulic cylinder means to thereby replenish lost fluid in said hydraulic cylinder means.

2. The fastener driving tool of claim 1, further including anticavitation means to prevent cavitation of the fluid when said hydraulic pressure means is deactivated.

3. The fastener driving tool of claim 2, wherein said anticavitation means includes a spring means mounted within said hydraulic cylinder means to urge said hydraulic piston to move to the retracted position when said hydraulic pressure means is deactivated.

4. The fastener driving tool of claim 3, wherein said anticavitation means further includes a flow restrictor means to regulate the speed at which the hydraulic piston moves between the retracted position and the extended position.

5. The fastener driving tool of claim 4, wherein said hydraulic cylinder means is attached to said housing by a rotating union means that permits said hydraulic cylinder means to rotate about a longitudinal axis.

6. A fastener driving tool to facilitate the insertion of remotely located fasteners into preformed openings in a structure, the fastener driving tool comprising:

a housing having a handle sized and shaped to permit gripping thereof by an operator's hand;

pneumatic cylinder means and pneumatic piston means mounted within said housing, said piston means being slidably mounted within said cylinder means for reciprocal movement between a first position and a second position;

control means for controlling the application of pressurized air to said pneumatic cylinder means and pneumatic piston means so that upon activation, pressurized air forces said pneumatic piston to slide from said first position to said second position, and upon deactivation said pressurized air forces said pneumatic piston to slide from said second position to said first position;

first hydraulic cylinder means and hydraulic piston means mounted within said housing, said hydraulic piston means being slidably mounted within said first hydraulic cylinder means for reciprocal movement between a first position and a second position, said hydraulic piston means being operatively associated with said pneumatic piston means such that it responds to movement of the pneumatic piston means and hydraulically intensifies any force developed by the movement of said pneumatic piston means from the first position to the second position;

second hydraulic cylinder means and second hydraulic piston means remotely located from said housing and being in fluid communication with said first hydraulic cylinder means and second hydraulic piston means, said second hydraulic piston means being mounted within said second hydraulic cylinder means to move between a retracted position and an extended position such that upon movement of said first hydraulic piston means from the first position to the second position said second hydraulic piston means moves to the extended position to thereby urge at least one fastener through a preformed openings; and a hydraulic fluid reservoir located within said housing, said hydraulic fluid reservoir being in fluid communication with said first and second hydraulic cylinder means only when said first hydraulic piston means moves to the first position such that fluid is directed from said reservoir to said first hydraulic cylinder means to thereby replenish lost fluid in the first and second hydraulic cylinder means.

7. The fastener driving tool of claim 6, further including anticavitation means to prevent cavitation of the fluid when said first hydraulic piston means moves from the second position to the first position.

8. The fastener driving tool of claim 7, wherein said anticavitation means includes a retraction means mounted on said second hydraulic cylinder means to urge said second hydraulic piston means to retract when said first hydraulic piston means moves from the second position to the first position.

9. The fastener driving tool of claim 8, wherein said retraction means comprises a spring means having a first end attached to said second hydraulic piston means and a second end attached to said second hydraulic cylinder means.

10. The fastener driving tool of claim 9, wherein said anticavitation means further includes a flow restrictor means in pneumatic communication with said pneumatic piston means to regulate the speed of the pneumatic piston means as it moves between the second position and the first position.

11. The fastener driving tool of claim 9, wherein said second hydraulic cylinder means is rotatably attached to said housing by a rotating union means.

* * * * *